US006057805A

United States Patent [19]

Harrington

[11] Patent Number: 6,057,805

[45] Date of Patent: May 2, 2000

[54] BROAD BAND SHAPED ELEMENT ANTENNA

[75] Inventor: Timothy E. Harrington, Austin, Tex.

[73] Assignee: EMC Test Systems, L.P., Austin, Tex.

[21] Appl. No.: 08/725,698

[22] Filed: Oct. 3, 1996

Related U.S. Application Data

[63] Continuation-in-part of application No. 08/699,469, Aug. 19, 1996.

[51] Int. Cl.[7] ..... H01Q 11/10

[52] U.S. Cl. ..... 343/792.5; 343/807; 343/808

[58] Field of Search ..... 343/792.5, 802, 343/807–809; H01Q 11/10

[56] References Cited

U.S. PATENT DOCUMENTS

| | | | |
|---|---|---|---|
| 2,175,253 | 10/1939 | Carter | 343/795 |
| 2,175,254 | 10/1939 | Carter | 343/807 |
| 2,642,528 | 6/1953 | Albright | 343/802 |
| 3,543,277 | 11/1970 | Pullara | 343/792.5 |
| 3,573,839 | 4/1971 | Parker, Jr. | 343/792.5 |
| 3,605,102 | 9/1971 | Frye | 343/802 |
| 3,875,572 | 4/1975 | Kay | 343/803 |
| 4,593,289 | 6/1986 | Newcomb | 343/795 |
| 4,754,287 | 6/1988 | Shelton et al. | 343/792.5 |
| 5,057,850 | 10/1991 | Kuo | 343/792.5 |
| 5,289,198 | 2/1994 | Altshuler | 343/729 |
| 5,293,176 | 3/1994 | Elliot | 343/797 |
| 5,367,312 | 11/1994 | Masters | 343/807 |
| 5,418,544 | 5/1995 | Elliot | 343/797 |

OTHER PUBLICATIONS

Balanis, Constantine A., *Antenna Theory Analysis and Design,* Chapter 8 "Broadbband Dipoles and Matching Techniques," New York: John Wiley & Sons, Inc., 1982, pp. 340–347.

*Primary Examiner*—Michael C. Wimer

*Attorney, Agent, or Firm*—Akin, Gump, Strauss, Hauer & Feld, L.L.P.

[57] ABSTRACT

A broad band electrically small antenna comprising opposed wire triangular outline shaped elements connected to a source or receiver at their respective apexes and a second set of wire outline shaped elements connected to the base members of the first set of triangular shaped or "bowtie" elements and extending in planes substantially normal to the plane of the triangular outline elements. The antenna exhibits a low antenna factor and relatively high gain and a relatively low voltage standing wave ratio at relatively low frequencies in the range of 20 to 200 megahertz, for example. The antenna may be connected to a log periodic dipole antenna array to provide broad band reception and transmission capability.

2 Claims, 6 Drawing Sheets

BROAD BAND SHAPED ELEMENT ANTENNA

CROSS REFERENCE TO RELATED APPLICATION

This application is a continuation-in-part of U.S. patent application Ser. No. 08/699,469, filed Aug. 19, 1996.

FIELD OF THE INVENTION

The present invention pertains to a broad band shaped element dipole antenna, particularly an apex fed opposed triangular element or "bowtie" antenna and a log periodic and triangular element antenna array, both including antenna elements extending normal to the plane of the triangular /elements at the distal ends of the triangular elements.

BACKGROUND

Antennas used in analyzing electromagnetic radiation emissions from and the immunity of various devices to such radiation should have relatively broad band or so-called frequency independent operating capability. Such antennas should, also, desirably have minimum physical size and mechanical simplicity for portability as well as cost considerations. For a considerable portion of the frequency band used in the above-mentioned electromagnetic compatibility testing, as well as in some communications applications, a half wave length dipole antenna is physically too large for many operating environments. In this regard, physical size restraints often require the use of so-called electrically small antennas or antennas that resonate at a resonance frequency corresponding to about 0.1 wave length of the emitted or received signal.

Certain improvements in shaped element dipole antennas for applications in electromagnetic compatibility testing as well as in certain communications applications, have been provided by the invention described and claimed in the above-referenced patent application. An antenna according to the invention in the above-referenced patent application includes a folded triangular element or "bowtie" dipole antenna which has been advantageous for minimizing antenna losses at the lower frequencies of the antenna frequency range than is possible with a conventional folded wire dipole antenna of the same physical size. Performance improvements for antennas which utilize the folded triangular shaped element dipole antenna in combination with a log periodic dipole array have also been realized with the antenna invention of the above-referenced patent application, which application is incorporated herein by reference. However, it has also been determined that under certain operating conditions, the folded triangular element antenna used alone, in combination with a log periodic antenna array or in combination with a single plane triangular shaped element antenna or a second folded triangular shaped element antenna may experience a phenomena known as mutual impedance which manifests itself as interference or parasitic coupling and caused by the folded triangular element antenna or the single plane triangular element antenna or the second folded triangular element antenna of an array. However, in accordance with the present invention, it has been discovered that performance improvements may be obtained along the lines disclosed in the above-referenced patent application by providing a triangular element antenna without the complete folded configuration but constructed in accordance with the invention as described hereinbelow.

SUMMARY OF THE INVENTION

The present invention provides an improved shaped element dipole antenna. The present invention also provides an improved shaped element dipole antenna and log periodic dipole antenna configured in an antenna array. The improved antenna and antenna array of the present invention is particularly adapted for measuring electromagnetic emissions from and the immunity of certain devices to such emissions, also known as electromagnetic compatibility testing. Such antenna are also useful in certain communications applications.

In accordance with one aspect of the present invention, a shaped element dipole antenna is provided wherein opposed triangular shaped wire elements are connected to a signal source or a receiver and wherein the signal source or receiver is connected to the apex of each of the triangular elements and the triangular elements are physically and electrically connected to shaped wire elements which extend in planes substantially normal to the triangular shaped elements and may each have a generally rectangular configuration. The rectangular shaped elements may extend normal to the plane of the triangular shaped elements in one direction from such plane or in both directions.

The antenna configuration of the present invention has a significantly lower resonance frequency than a so-called single wire dipole antenna of the same physical length and has the advantages of the antenna described in the above-referenced patent application while avoiding some of the mutual impedance or interference characteristics associated with a completely folded element antenna in accordance with the above-referenced patent application.

The triangular element antenna with the transverse, generally rectangular shaped elements, in combination with a log periodic antenna array, provides an antenna adapted for improved performance over a wide frequency range wherein a lower antenna factor (or higher gain) and a low voltage standing wave ratio (VSWR) characteristic is experienced at lower frequencies than is possible with a single triangular element (bowtie) antenna and log periodic antenna array or a folded bowtie antenna and log periodic antenna array of the same physical size. Moreover, the antenna of the present invention also exhibits improved performance in an operating signal frequency range between the optimum frequency ranges of a log periodic dipole antenna array and the triangular element dipole antenna.

The antenna of the present invention, for the improved characteristics described further herein, may be physically no larger than the antenna described and claimed in the above-referenced patent application, is mechanically less complicated, lighter in weight and may enjoy all of the advantages of the antennas described in the referenced patent application.

Those skilled in the art will further appreciate the above-mentioned features and advantages of the invention together with other important aspects thereof upon reading the detailed description which follows in conjunction with the drawing.

DESCRIPTION OF THE PREFERRED EMBODIMENTS

Figure 1:
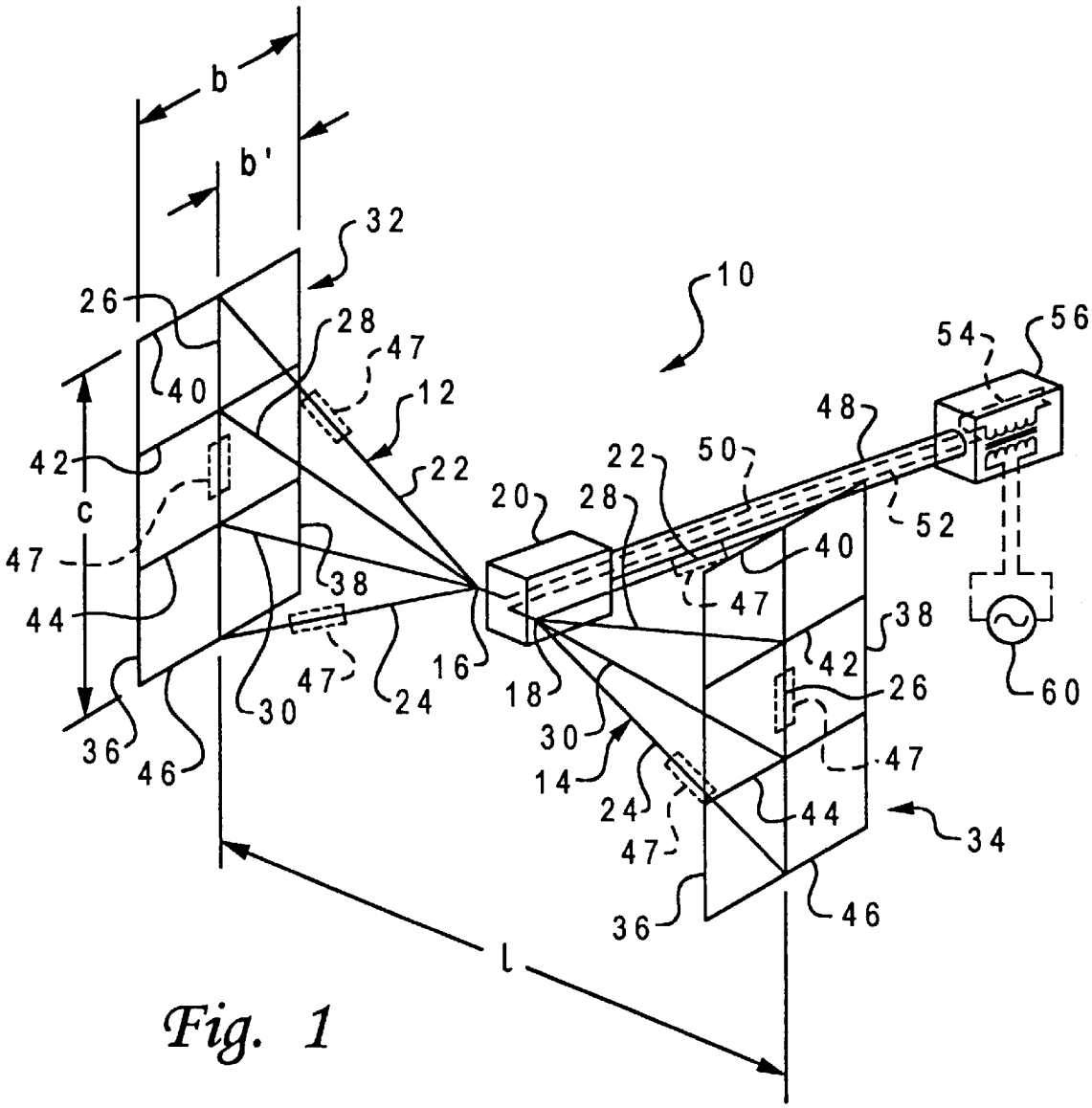
FIG. 1 is a perspective view of a broad band shaped element antenna in accordance with the invention.

In the description which follows, like elements are marked throughout the specification and drawing with the same reference numerals, respectively. The drawing figures are not necessarily to scale and certain elements are shown in somewhat generalized or schematic form in the interest of clarity and conciseness.

Referring to FIG. 1, there is illustrated a shaped element antenna in accordance with the invention and generally designated by the numeral 10. The antenna 10 is characterized by a pair of opposed triangular shaped antenna elements 12 and 14, having respective apexes 16 and 18 supported on a suitable support member 20. The triangular antenna element 12 has opposed, diverging, wire or metal tube outer strut members 22 and 24 interconnected by a base member 26 to form the triangular shaped element 12. The strut members 22 and 24 are also interconnected or merged with each other at the apex 16. Intermediate spaced apart diverging strut members 28 and 30 also extend between apex 16 and the base member 26. The triangular element 14 is also provided with opposed diverging strut members 22 and 24, a base member 26 and intermediate strut members 28 and 30 arranged in the same configuration as antenna element 12.

The antenna 10 is further provided with transverse antenna elements 32 and 34 which are each characterized as respective rectangular wire or metal tube shaped elements having spaced apart strut members 36 and 38 generally parallel to the base members 26 and which are interconnected by plural, spaced apart generally parallel strut members 40, 42, 44 and 46 extending normal to strut members 36 and 38. The strut members 40, 42, 44 and 46 are connected, preferably, midway between their opposite ends to the base member 26 of each triangular antenna element 12 and 14.

As also shown in FIG. 1, the support 20 may be connected to a further support member 48, comprising a boom or mast through which suitable conductors 50 and 52 are trained and are connected to the respective antenna apexes 16 and 18. The conductors 50 and 52 are also connected to a suitable balun transformer 54 disposed in an enclosure 56. The transformer 54 is connected to a suitable signal source 60, the reciprocal of which may be a receiver. The transverse antenna elements 32 and 34 have been determined to improve the performance of a triangular element or so-called "bowtie" antenna without causing some of the mutual impedance or interference problems associated with a folded triangular element antenna, at least with respect to operating at certain receiving or transmitting frequencies. The antenna elements 32 and 34 preferably extend in planes normal to the plane of the antenna elements 12 and 14. Although the plane of the antenna elements 12 and 14 may be the same, or the antenna elements 12 and 14 may be disposed in planes which are slightly offset from each other but parallel to each other, for purposes of this discussion it will be assumed that the antenna elements 12 and 14 are substantially coplanar and the antenna elements 32 and 34 extend in planes substantially parallel to each other but normal to the plane of the elements 12 and 14. Still further, the antenna elements 32 and 34 may be configured such that they extend in only one direction from the plane of the antenna elements 12 and 14, respectively, rather than being configured to extend substantially equidistant in opposite directions from the planes of the antenna elements 12 and 14, as illustrated in FIG. 1.

An antenna 10 having an overall length, 1, between base members 26 of the respective antenna elements 12 and 14 of about 1.30 meters, an included angle between elements 22 and 24 of about sixty degrees at the respective apexes, an included angle of about twenty degrees between strut members 28 and 30, an overall width, b, of elements 32 and 34 of about 0.60 meters, a dimension b' of about 0.30 meters and a length or height, c, of elements 26, 36 and 38 of about 0.75 meters is suitable for operating frequencies in the range of twenty to two hundred megahertz. The struts described may be welded at their contiguous points. The diameters of the struts 22, 24, 26, 28, 30, 36, 38, 40, 42, 44 and 46 may be about 12.7 mm for an antenna having the other physical dimensions discussed hereinabove. The struts may be of other cross-sectional configurations and cross-sectional dimensions, if desired. The intermediate strut members 28, 30, 42 and 44 are desirable but are not required for inclusion in an antenna in accordance with the present invention.

Figure 2A:
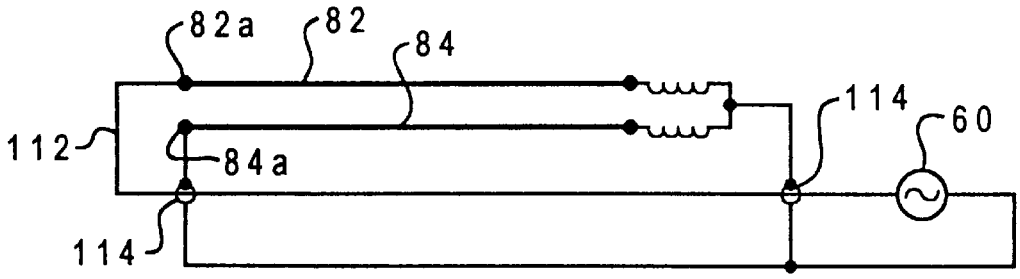
FIG. 2A is a schematic diagram for an antenna in accordance with the invention.
Figure 2:
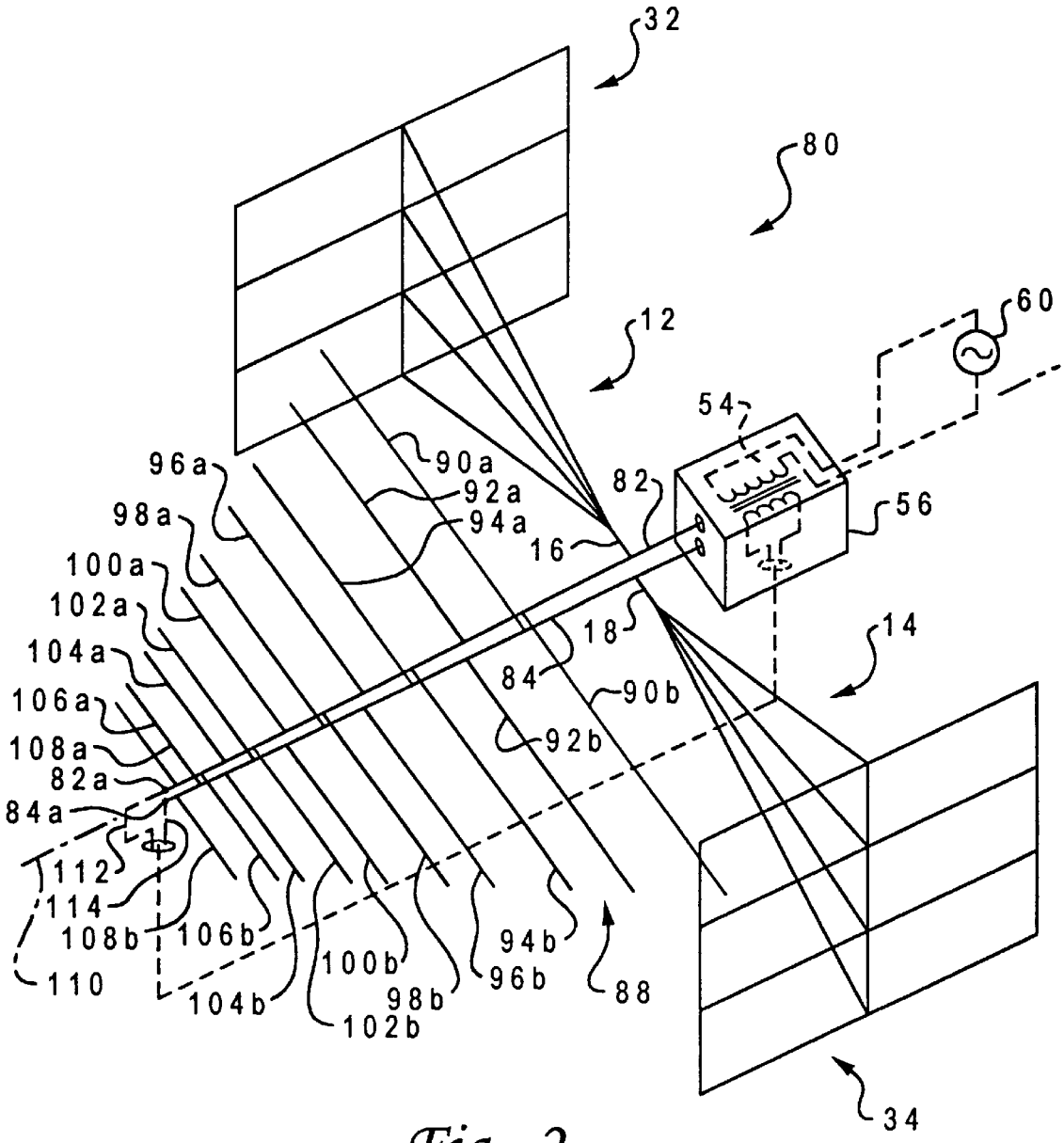
FIG. 2 is a perspective view of an alternate embodiment of an antenna in accordance with the invention.

Referring now to FIG. 2, there is illustrated, in somewhat schematic form, an antenna or so-called antenna array adapted for electromagnetic radiation emission and immunity testing, and generally designated by the numeral 80. The antenna 80 includes the triangular element antenna shown in FIG. 1, that is, including the opposed triangular elements 12 and 14 and the respective transverse antenna elements 32 and 34 connected thereto, respectively. In the antenna 80, the apexes 16 and 18 are mechanically and electrically connected to spaced apart elongated boom members 82 and 84, formed of suitable conductive metal tubing, for example. In the antenna 80, the booms 82 and 84 may be mechanically connected to the aforementioned balun transformer enclosure 56, which is preferably constructed of a suitable non-conductive material.

The boom members 82 and 84 also support a log periodic antenna array, generally designated by numeral 88, spaced along the boom members, as shown, and characterized by plural, opposed wire or metal tube dipole antenna elements of respective lengths required for transmitting and receiving radiation of selected frequencies, in a known manner. Representative ones of the opposed wire dipole elements of array 88 are shown and indicated by numerals 90*a*, 90*b*, 92*a*, 92*b*, 94*a* and 94*b*, 96*a*, 96*b*, 98*a*, 98*b* and so on through 108*a*, 108*b*, as shown in FIG. 2. As many as twenty-three wire dipole antennas may be mounted on booms 82 and 84, by way of example, for an antenna operating at frequencies between twenty megahertz and two gigahertz. More or fewer dipole elements may be provided. The antennas described herein, for operation at twenty megahertz to two hundred megahertz may have ten dipole elements, for example. Alternate antenna elements on the opposite side of longitudinal centerline or axis 110 of antenna 80 are connected to respective ones of the booms 82 and 84 to provide the desired phase relationship for signals received or emitted by the antenna 80. Signal reception or transmission from source 60 is communicated to the distal ends 82*a* and 84*a* of the booms 82 and 84 by suitable conductors 112 and 114 which are electrically connected to source 60 through the aforementioned balun transformer 54 or as otherwise described herein.

Those skilled in the art will appreciate that the balun 54 comprises a so-called common mode choke. However, an arrangement as shown in FIG. 2A is actually preferred for blocking common mode currents in the boom conductors 82 and 84. In FIG. 2A, a coaxial cable comprising the conductors 112 and 114 may be connected directly to source 60 and the outer conductor of the coaxial cable may form two parallel inductors which block common mode currents from capacitively coupling to the coaxial cable outer conductor creating an asymmetric operating condition. The parallel inductors of the aforementioned coaxial cable may also be tapped to provide some impedance matching to the capacitive impedance of the bowtie antenna. A schematic diagram illustrating this arrangement is shown in FIG. 2A.

Figure 3:
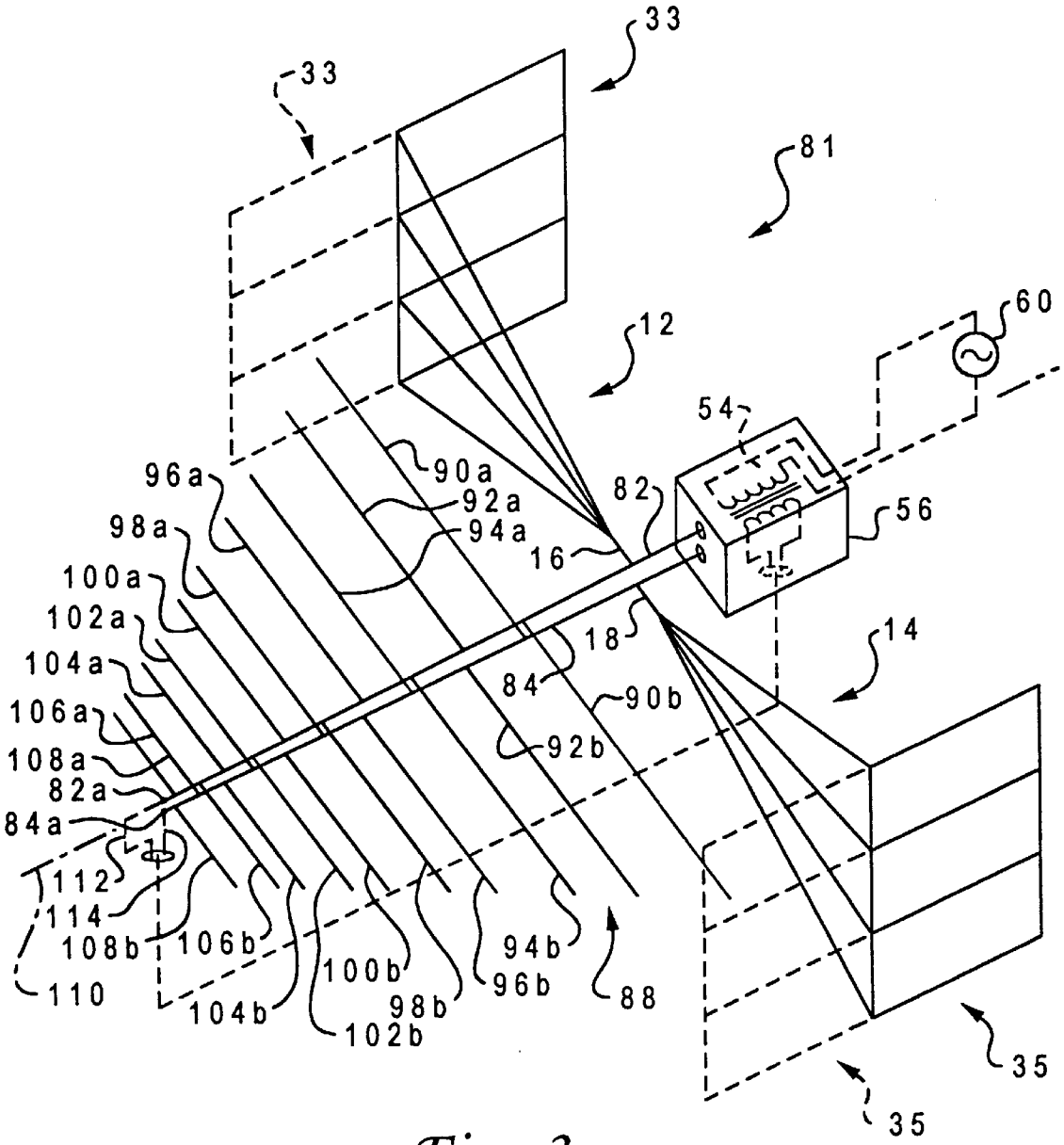
FIG. 3 is a perspective view of a modified antenna similar to the embodiment shown in FIG. 2.

Referring now to FIG. 3, another embodiment of an antenna similar to the antenna 80 is illustrated and generally designated by the numeral 81. The antenna 81 is substantially the same as the antenna 80 except the transverse rectangular elements 32 and 34 are replaced by elements 33 and 35, respectively, which extend in only one direction from the plane of the elements 12 and 14. The elements 33 and 35 may extend in a direction away from the log periodic antenna array 88 or in a direction toward the log periodic antenna array 88, as indicated by the alternate positions of element 33 and 35. In either case, the loading of the antenna elements 12 and 14 provided by the antenna elements 33 and 35 is expected to improve the performance of an antenna such as the antenna 81 in the frequency range discussed herein for the antennas 10 and 80. In any of antennas 10, 80 or 81 lumped impedances 47, FIG. 1, may be utilized to modify antenna loading.

Figure 4:
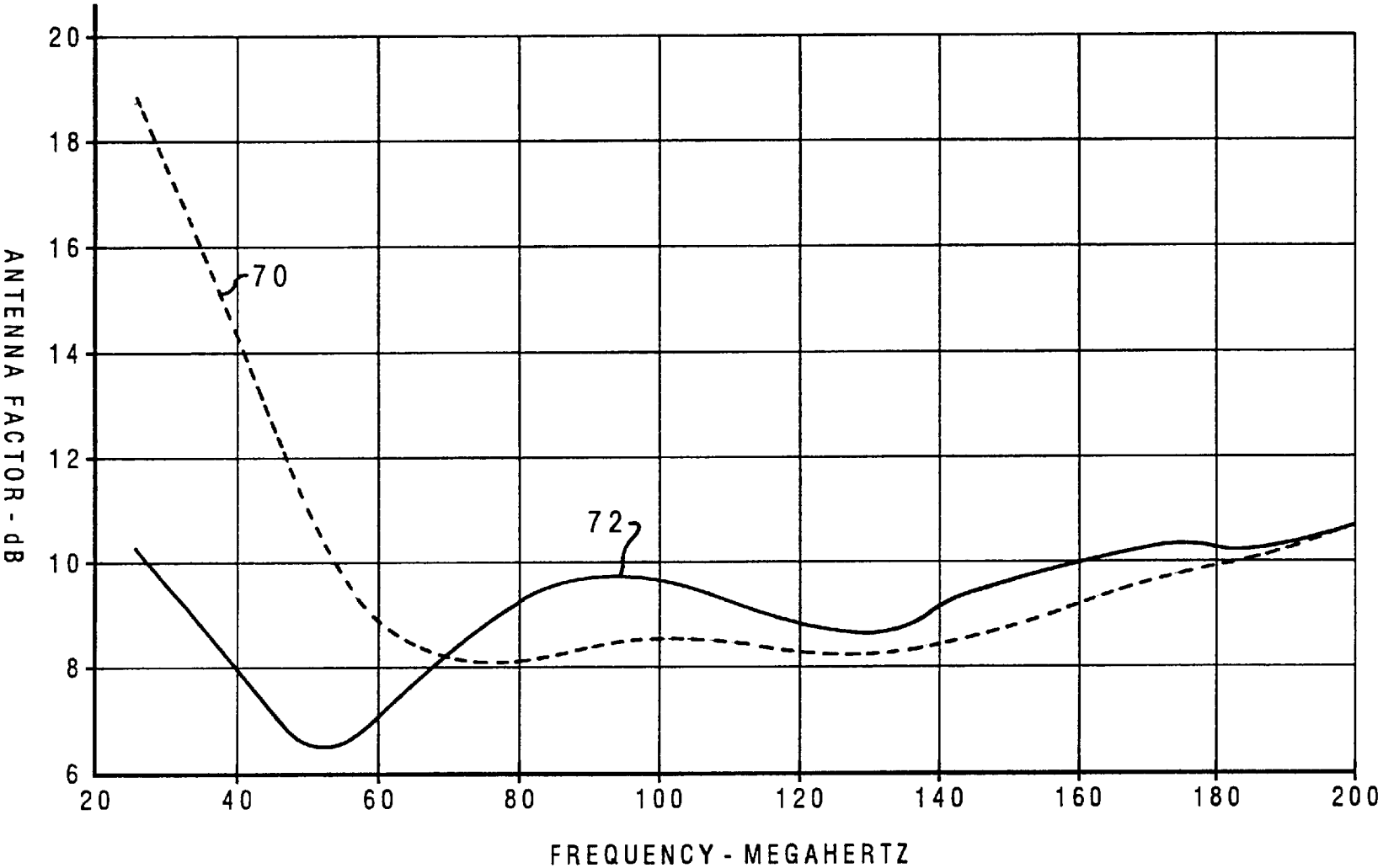
FIGS. 4 through 6 are diagrams showing the performance characteristics of the antenna embodiment illustrated in FIG. 2.

Referring now to FIG. 4, there is illustrated a diagram of antenna factor in decibels versus frequency in megahertz for the antenna 80 as compared with a similar antenna having triangular shaped or bowtie elements without the transverse elements 32 and 34 of the present invention. The dashed line curve 70 in FIG. 4 represents the antenna factor for the aforementioned antenna without the transverse elements 32 and 34 while the solid line 72 indicates the antenna factor for the antenna 80. It will be noted from FIG. 4 that in a range of frequencies between about 75 megahertz to 200 megahertz, there is not a significant difference in the antenna factor between the two types of antennas. However, in a frequency range of transmitted or received signals of between about 25 megahertz to 70 megahertz, the antenna 80 shows marked improvement. Although the discussion herein refers to antenna factor for the antennas described and claimed, those skilled in the art will recognize that the reciprocal performance factor known as gain is applicable for applications of the antennas for transmitting electromagnetic radiation whereas antenna factor is the figure of merit or applications wherein the antenna is receiving electromagnetic radiation signals. In accordance with the principle of reciprocity, high gain is desirable under the same circumstances that a low antenna factor is desirable, depending on the application of the antenna.

Figure 5:
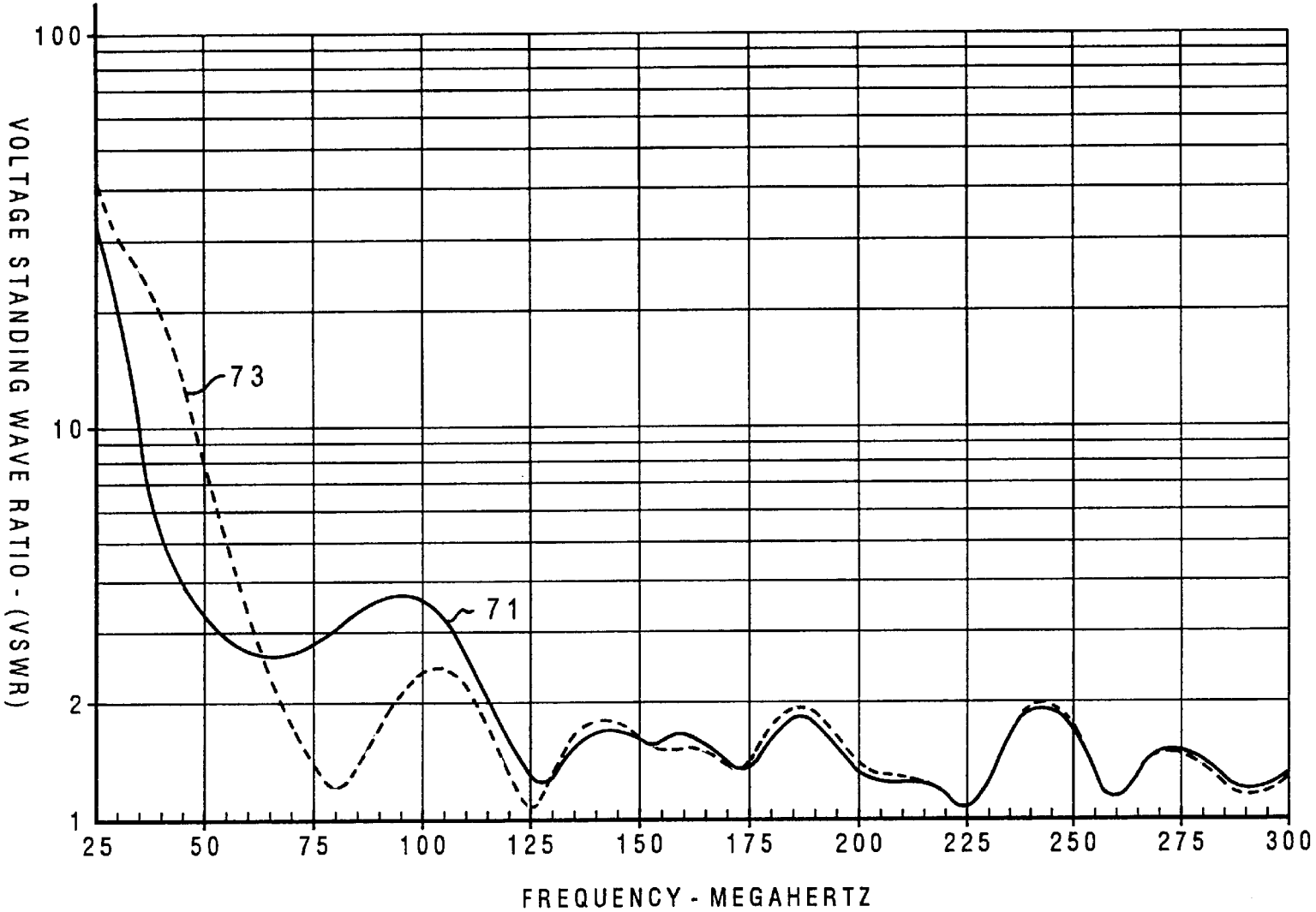
Figure 6:
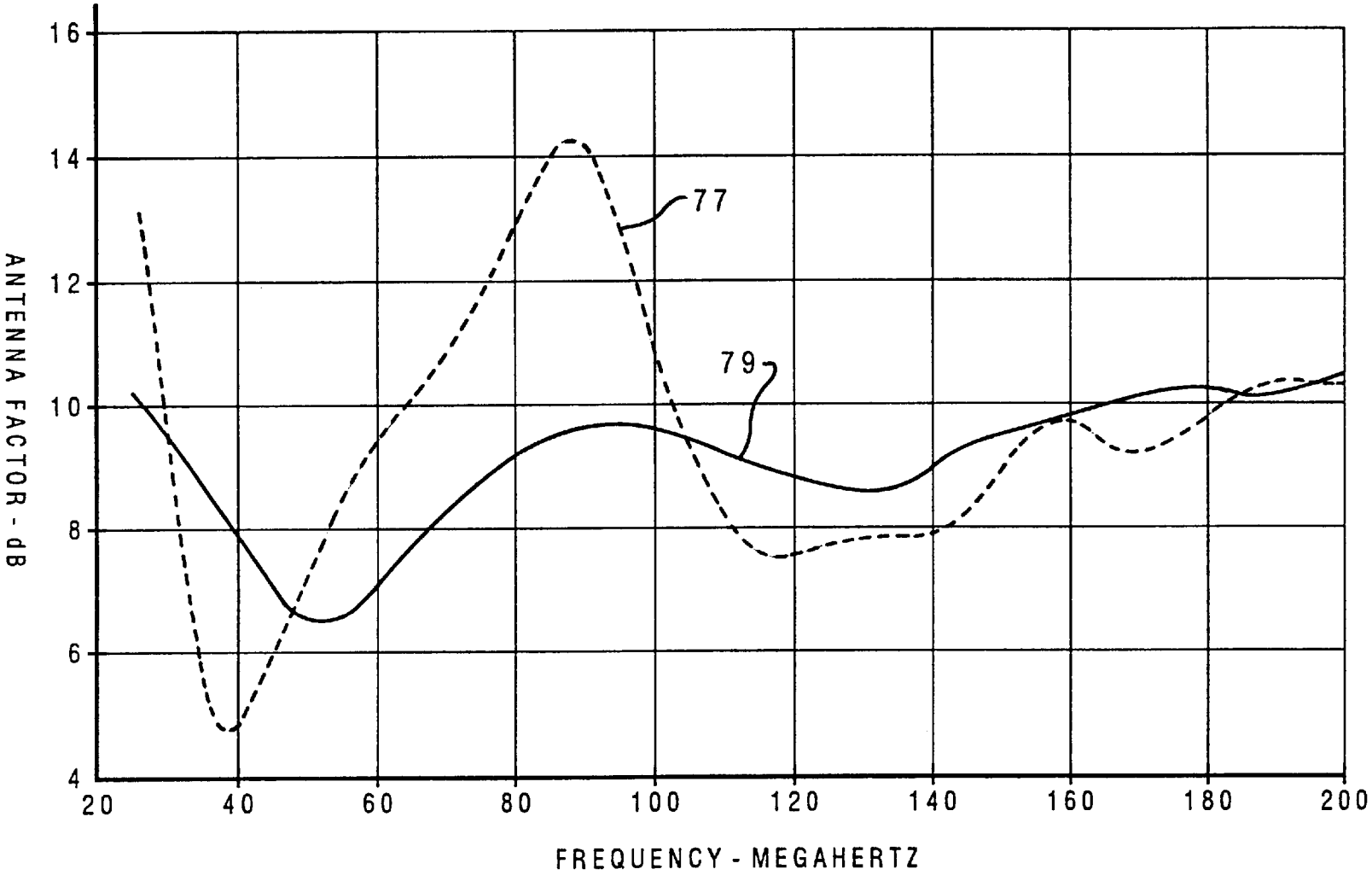

Moreover, the ranges of frequencies discussed herein with respect to FIGS. 4 through 6, are for the antenna having the dimensions described above. Those skilled in the art will recognize that if the size of the antenna is varied, that the frequencies at which the antenna 80, for example, will show marked improvements will vary also. For example, if the dimensions of antenna 80 are doubled, the optimum frequency range will be twelve megahertz to thirty-five megahertz and if the size of the antenna 80 is half that described above, the optimum frequency range discussed would be approximately fifty megahertz to one hundred forty megahertz.

Referring to FIG. 5, there is illustrated a diagram of voltage standing wave ratio (VSWR) versus frequency in megahertz comparing the performance of the antenna 80, as indicated by the solid line 71, with the performance of a single plane bowtie and log periodic antenna, described in conjunction with FIG. 4, as indicated by the dashed line 73. As shown in FIG. 5, there is essentially no difference in VSWR for signals transmitted or received by the two types of antennas in a frequency range of between about 110 megahertz to 300 megahertz. Although the antenna 80 has a higher VSWR between about 62 megahertz and 130 megahertz, this VSWR is below a level of about 10:1, which is acceptable for many antenna applications, including those contemplated by the present invention. However, as also shown in FIG. 5, the antenna 80 has an acceptable VSWR for operation in a frequency range of about 35 to 62 megahertz and, in particular, antenna 80 has an acceptable VSWR for operating frequencies lower than the capabilities of the antenna with the single plane triangular element or bowtie antenna. The comparisons of FIGS. 4 and 5 are for antennas having the same dimensions except, of course, for the addition of the transverse antenna elements 32 and 34. It should be mentioned that in electromagnetic compatibility testing, antennas with a VSWR of greater than 10:1 are commonly used. A VSWR of 100:1 may be experienced in some cases. For the antennas described herein, the antenna factor and/or gain determines the low operating frequency limit, that is, an antenna factor of less than about 15 decibels.

Referring now to FIG. 6, there is illustrated a diagram of antenna factor in decibels versus frequency in megahertz for the antenna 80 as compared with an antenna having the same physical features and dimensions except for the use of a folded triangular element antenna in the array. The dashed curved line 77 in FIG. 6 represents the antenna factor versus frequency for a log periodic antenna array with a folded triangular element antenna in combination and indicating that in a frequency range of between about 65 megahertz to 105 megahertz, the antenna factor for the aforementioned antenna becomes greater than 10 decibels, an undesired characteristic. On the other hand, the solid line curve 79 in FIG. 6 represents the antenna factor versus frequency for the antenna 80 indicating that the antenna factor remains well below 10 decibels and below the aforementioned antenna represented by the curve 77, particularly between frequencies of about 105 megahertz down to about 45 to 50 megahertz. Moreover, it is also desirable to avoid an erratic or jagged curve of antenna factor versus operating frequency. The solid line curve 79 in FIG. 6 is, as shown, a smoother curve, that is one having fewer abrupt changes in slope.

The construction and operation of the antennas 10, 80 and 81 and the components included therein are believed to be within the purview of one of ordinary skill in the art of broad band antennas based on the foregoing description. Those elements not described in detail may be constructed using conventional materials for antennas for receiving and transmitting electromagnetic radiation in the frequency ranges indicated herein.

Although preferred embodiments of the invention have been described in detail, those skilled in the art will recognize that various substitutions and modifications may be made to the invention without departing from the scope and spirit of the appended claims.

What is claimed is:

1. An electromagnetic compatibility test antenna array comprising a shaped element antenna including a first set of opposed triangular shaped and substantially planar antenna elements projecting in substantially opposite directions and having respective apexes connected to respective ones of elongated conductor means, a second set of opposed rectangular shaped antenna elements connected only to respective ones of said opposed shaped antenna elements of said first set at distal end base members thereof, respectively, and extending in planes substantially normal to a substantially common plane of said antenna elements of said first set;

a log periodic dipole antenna array connected to said first set of antenna elements, respectively, via said respective conductor means; and said rectangular shaped elements and said triangular shaped elements are each characterized by wire or tube struts defining an outline of said rectangular shaped elements and said triangular shaped elements, respectively, at least one of said triangular shaped elements and said rectangular shaped elements include intermediate strut members extending between the strut members which define said outline, and said antenna array exhibits an antenna factor of less than 10 decibels in a signal receive or transmit operating mode for electromagnetic radiation signals having a frequency of between about 25 megahertz and 160 megahertz.

2. An electromagnetic compatibility test antenna characterized by:

spaced apart elongated electrically conductive boom members;

a shaped element antenna connected to said boom members comprising a first set of opposed triangular shaped substantially planar antenna elements extending substantially only within a common plane and having respective apexes connected to respective ones of said members and having base members disposed spaced from said boom members;

a second set of antenna elements connected only to said base members of said triangular shaped elements, respectively, and extending in planes substantially normal to a substantially common plane in which said triangular shaped elements are disposed, said first set of elements and said second set of elements comprising wire or tube triangular outlines and wire or tube rectangular outlines, respectively; and a log periodic antenna array comprising plural opposed wire dipole antenna members connected to said boom members, respectively, at points spaced from said triangular shaped antenna elements whereby said antenna is operable to exhibit an antenna factor of less than about 10 decibels for a signal receive or transmit frequency range of about 25 megahertz to 160 megahertz.

* * * * *